US008706010B2

(12) United States Patent
Takehara et al.

(10) Patent No.: US 8,706,010 B2
(45) Date of Patent: Apr. 22, 2014

(54) IMAGE FORMING APPARATUS USING A TONER CONTAINER IN WHICH THE TONER OUTLET MAY BE POSITIONED IN A HORIZONTAL OR VERTICAL DIRECTION

(75) Inventors: Atsushi Takehara, Kyoto (JP); Tomohiro Kubota, Osaka (JP); Naoki Nakatake, Hyogo (JP); Sho Tsuritani, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 376 days.

(21) Appl. No.: 13/194,007

(22) Filed: Jul. 29, 2011

(65) Prior Publication Data

US 2012/0033996 A1 Feb. 9, 2012

(30) Foreign Application Priority Data

Aug. 3, 2010 (JP) ..... 2010-174512

(51) Int. Cl.
*G03G 15/08* (2006.01)

(52) U.S. Cl.
USPC ..... 399/258; 399/262

(58) Field of Classification Search
USPC ..... 399/106, 258, 260, 262
See application file for complete search history.

(56) References Cited

U.S. PATENT DOCUMENTS

| | | | | |
|---|---|---|---|---|
| 5,828,935 | A | 10/1998 | Tatsumi et al. | |
| 7,149,462 | B2 * | 12/2006 | Kawamura et al. | 399/262 |
| 7,162,189 | B2 | 1/2007 | Tsuda et al. | |
| 7,277,664 | B2 | 10/2007 | Katsuyama et al. | |
| 7,835,675 | B2 | 11/2010 | Taguchi et al. | |

FOREIGN PATENT DOCUMENTS

| | | |
|---|---|---|
| JP | 3691489 | 6/2005 |
| JP | 4014335 | 9/2007 |
| JP | 4249994 | 1/2009 |
| JP | 4396946 | 10/2009 |
| JP | 4476617 | 3/2010 |

* cited by examiner

*Primary Examiner* — William J Royer
(74) *Attorney, Agent, or Firm* — Oblon, Spivak, McClelland, Maier & Neustadt, L.L.P.

(57) ABSTRACT

An image forming apparatus, including an image developer to develop an electrostatic latent image and a toner provider to provide a toner from a toner container to the image developer in a direction of gravitational force. The toner container is capable of taking a first position of directing a toner outlet in a horizontal direction; a second position of directing the toner outlet in a direction of gravitational force; and a position of being removed, directing the toner outlet upward relative to the horizontal direction when further rotating from the first position. The toner container includes a main cap member to close the toner outlet when taking the first position and the position of being removed; and a sub-cap member to cover the main cap member while the toner container is displaced from the first position to the position of being removed.

10 Claims, 5 Drawing Sheets

IMAGE FORMING APPARATUS USING A TONER CONTAINER IN WHICH THE TONER OUTLET MAY BE POSITIONED IN A HORIZONTAL OR VERTICAL DIRECTION

BACKGROUND OF THE INVENTION

1. Field of the Invention

The present invention relates to an image forming apparatus, such as a copier, printer, facsimile machine, or a multifunctional device combining several such functions.

2. Discussion of the Background

In the electrophotographic image forming apparatus market, lowering running costs is a long-felt need. Toward that end, various methods of extending the working life of process cartridges that are used in such apparatuses are disclosed, including use of a removable toner cartridge independently replaceable from an image forming apparatus is disclosed.

In the toner cartridge, toner is delivered from a toner container to a developing unit. In a case in which the toner is delivered using the force of gravity, a complicated member for feeding the toner to the developing unit is not needed in the toner container. Such a gravity-feed configuration has the advantage of being inexpensive, thereby contributing to the lowest running cost. However, a drawback of this arrangement is that a powder pressure of the toner is not controlled because the toner is gravitationally fed from the toner container, and therefore an outlet thereof may be contaminated with the toner when a toner container still containing toner is removed from the image forming apparatus. When the outlet is opened and closed while the powder pressure is high, an opening and closing member of the developing unit is contaminated. Further, because the outlet faces downward, any toner adhering to the outlet tends to scatter and contaminate the surrounding area inside the apparatus.

Therefore, to minimize uncontrolled scattering of the toner adhering to the outlet, typically the outlet is located in a horizontal direction of the toner container so that the outlet does not face downward when the toner container is removed from the apparatus. Alternatively, a toner container having the outlet located at an end in a horizontal direction of the toner container and facing downward without powder pressure is known.

However, conventional toner containers having an outlet in a horizontal direction do not have a power to feed a toner into a developing unit, thus necessitating use of a complicated part such as a feed screw for feeding the toner forward, resulting in a larger and more costly toner container.

In short, a toner container having a downward facing outlet costs less but cannot avoid scattering toner. By contrast, a toner container having an outlet facing in a horizontal direction can avoid scattering the toner but becomes bulky and expensive.

SUMMARY OF THE INVENTION

Accordingly, an object of the present invention is to provide a compact low-cost image forming apparatus in which a toner container is easily replaceable and a toner is effectively prevented from scattering.

This and other objects of the present invention, either individually or collectively, have been satisfied by the invention of an improved image forming apparatus, comprising:

an image developer configured to develop an electrostatic latent image; and a toner provider configured to provide a toner from a toner container to the image developer in a direction of gravitational force, wherein the toner container is capable of taking:

a first position of directing a toner outlet in a horizontal direction;

a second position of directing the toner outlet in a direction of gravitational force; and a position of being removed, directing the toner outlet upward relative to the horizontal direction when further rotating from the first position, the toner container comprises:

a main cap member configured to close the toner outlet when taking the first position and the position of being removed; and a sub-cap member configured to cover the main cap member while changing the first position to the position of being removed.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a compact low-cost image forming apparatus in which a toner container is easily replaceable and a toner is effectively prevented from scattering.

More particularly, the present invention relates to an image forming apparatus, comprising:

an image developer configured to develop an electrostatic latent image; and a toner provider configured to provide a toner from a toner container to the image developer in a direction of gravitational force, wherein the toner container is capable of taking:

a first position of directing a toner outlet in a horizontal direction;

a second position of directing the toner outlet in a direction of gravitational force; and a position of being removed, directing the toner outlet upward relative to the horizontal direction when further rotating from the first position, the toner container comprises:

a main cap member configured to close the toner outlet when taking the first position and the position of being removed; and a sub-cap member configured to cover the main cap member while changing the first position to the position of being removed.

Figure 1:
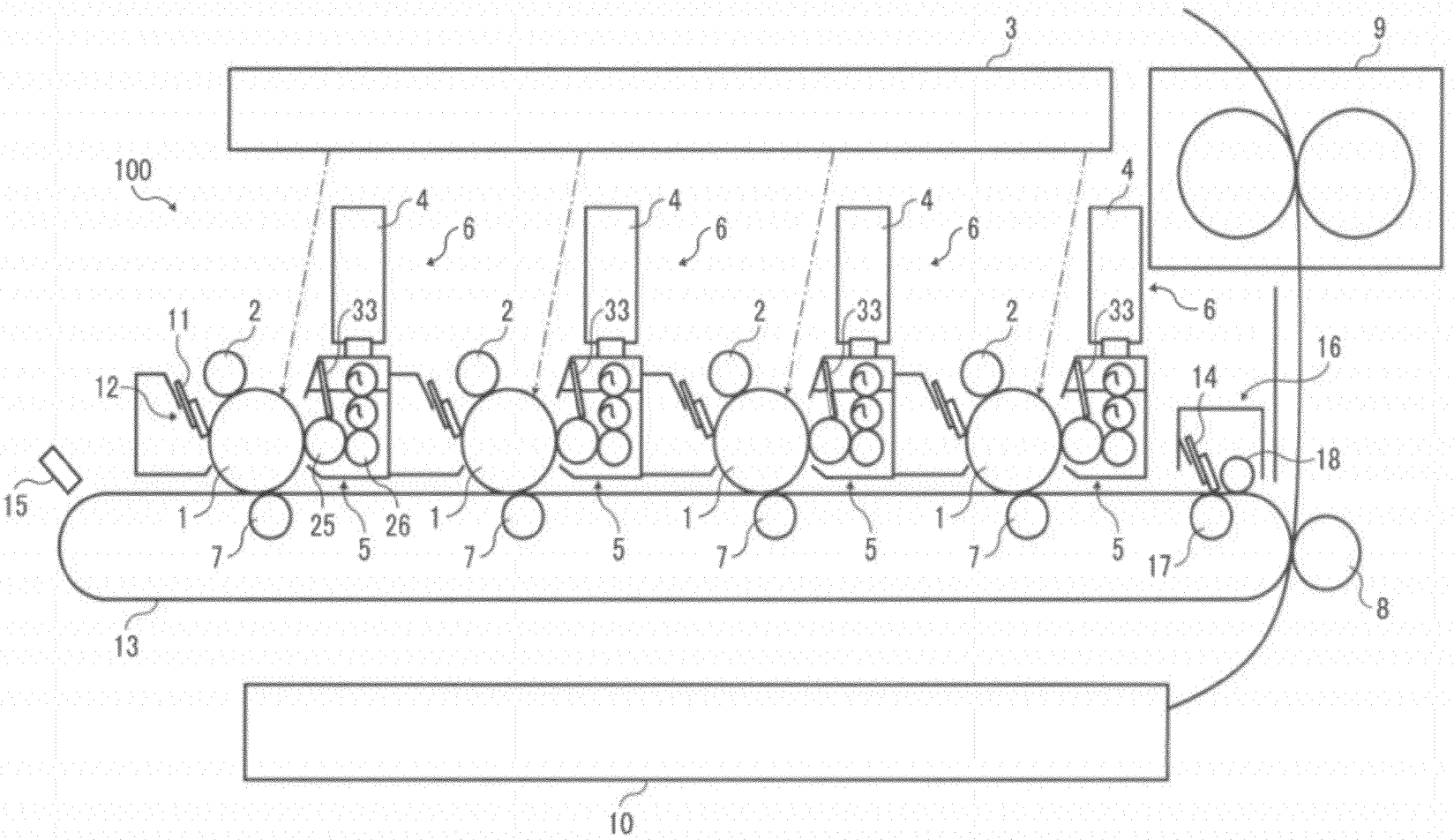
FIG. 1 is a schematic view illustrating an embodiment of the image forming apparatus of the present invention.

FIG. 1 is a schematic view illustrating an embodiment of an image forming apparatus 100 of the present invention. The image forming apparatus 100 includes a charger 2 for uniformly charging the surface of a photoreceptor drum 1 as an image bearer, an irradiator 3 for irradiating the uniformly-charged surface to form a latent image thereon, an image developer 5 for attaching a toner to the latent image on the surface of the photoreceptor drum 1 to form a toner image thereon, a transferer 7 for transferring the toner image formed on the photoreceptor drum 1 onto a receiving material, and a cleaner 12 for removing the toner remaining on the photoreceptor drum 1.

Above the image developer 5, a toner provider 6 is located, which contains a replaceable toner and provides a toner T into the image developer 5 while connecting therewith. The toner provider 6 includes a toner container 4. The toner container 4 directly provides the toner T into the image developer 5. The toner container 4 may provide the toner T into the image developer 5 through a supply route in the image forming apparatus 100.

In a tandem-type image forming apparatus, each monochrome color, mainly a black, magenta, cyan and yellow image is formed on the surface of each photoreceptor drum 1. When an image is formed by a nega-posi method (a toner adheres to a lower potential part) therein, the photoreceptor drum 1, the surface of which is uniformly charged by the charger (charging roller) 2 is irradiated by the irradiator 3 to form an electrostatic latent image thereon, and the image developer 5 attaches a toner thereto to form a visual image.

The toner image is transferred by the transferer 7 onto an intermediate transfer belt 13 from the surface of the photoreceptor drum 1, and the untransferred toner therefrom is removed from the surface of the photoreceptor drum 1 by a cleaning blade 11 of the cleaner 12. The toner image transferred onto the intermediate transfer belt 13 is transferred by a second transfer roller 8 onto a recording paper fed from a paper feed tray 10 at a second transfer site. The residual toner and external additive after transfer are removed by a cleaning unit 16. The toner image transferred onto the recording paper is melted and bonded thereon by a unit 9, and the recording paper with the toner image bonded thereon is discharged from an unillustrated paper ejection opening.

The apparatus 100 includes a sensor 15 used for controlling image density and positional adjustment, and the cleaning unit 16 cleaning the toner remaining on the surface of the intermediate transfer belt 13. The sensor 15 measures an amount of the toner transferred onto the intermediate transfer belt 13 and positions of each color to control image density and positional adjustment. The cleaning unit 16 has a cleaning blade 14 which contacts the belt 13 in a counter direction relative to a travel direction of the belt 13, and a metallic cleaning counter roller 17. The toner removed by the cleaning blade 14 is transported by a transport coil 18 into an unillustrated waste toner container.

Figure 2:
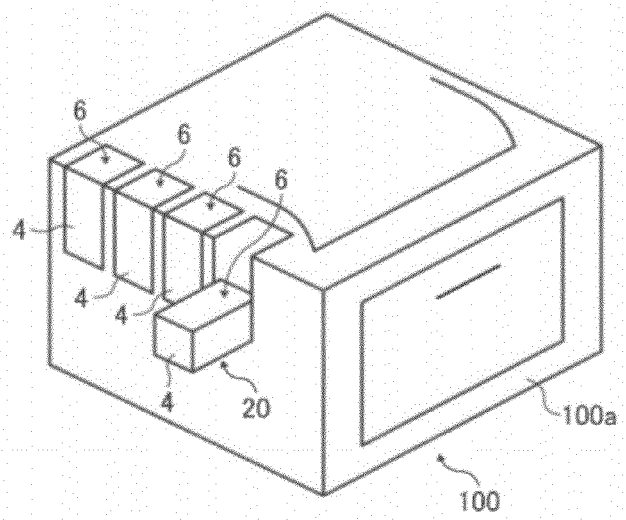
FIG. 2 is a simple perspective view illustrating a relationship between the image forming apparatus and a toner container.
Figure 3:
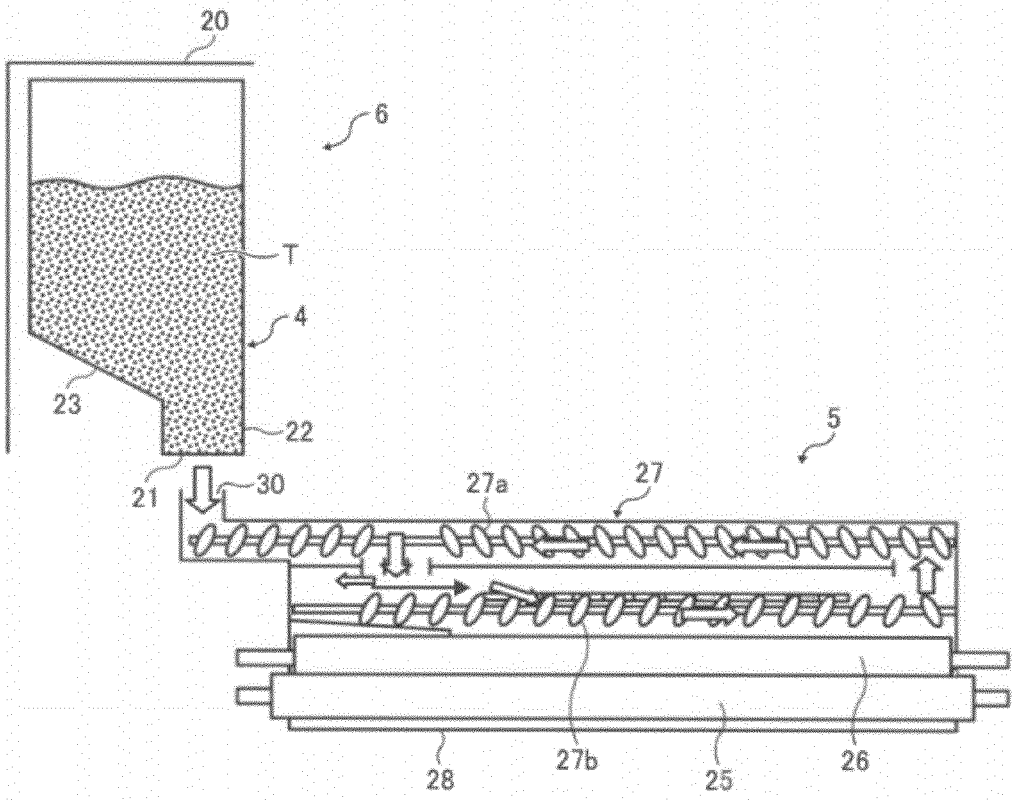
FIG. 3 is a cross-sectional view illustrating a relationship between the toner container and an image developer (developing unit)
Figure 5:
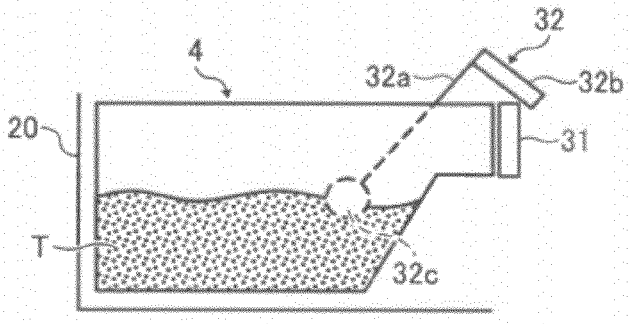
FIG. 5 is a cross-sectional view illustrating the toner container in a first position.

FIG. 3 is a cross-sectional view illustrating a configuration of the toner provider 6 and the image developer (developing unit) 5, and the toner container 4 is contained in an external cover 20. The cover 20 is swingably attached to a case 100*a* as FIG. 2 shows. The toner container 4 is in a first position of directing a toner outlet 21 in a horizontal direction as FIG. 5 shows, and in a second position of directing the toner outlet 21 downward as FIG. 3 shows.

In the toner container 4 in the second position, a projection 22 is formed through a tapered part 23 at the bottom, and the toner outlet 21 is formed on the lower surface of the projection 22. When the toner container 4 changes its position from the second position to the first position, the toner outlet 21 faces in a horizontal direction as FIG. 5 shows. In addition, the toner outlet 21 is located above in the toner container 4 in the first position.

In the image developer 5, a developing roller 25 as a developer bearer, a feed roller 26 and a toner feed member 27 are contained in a case 28 as FIG. 3 shows. The toner feed member 27 includes a first feed screw 27*a* and a second feed screw 27*b*. The case 28 includes a toner feed opening 30 facing the toner outlet 21 of the toner container 4 in the second position. Therefore, a toner T is fed from the toner outlet 21 of the toner container 4 to the toner feed opening 30.

When the toner T is fed into the case 28, the toner T is fed in an arrow direction. The toner T fed by the feed roller 26 onto the developing roller 25 and adhering thereto is uniformed by a regulation blade 33 in FIG. 1. Then, a toner in an amount in compliance with a surface potential of the photoreceptor drum 1 moves to the surface thereof. As mentioned above, the toner is then transferred by the transferer 7 from the surface of the photoreceptor drum 1, and a toner untransferred therefrom to the intermediate transfer belt 13 is removed therefrom by the cleaning blade 11 of the cleaner 12. The waste toner removed by the cleaning blade 11 is collected in an unillustrated waste toner container in the image forming apparatus 100.

Figure 4:
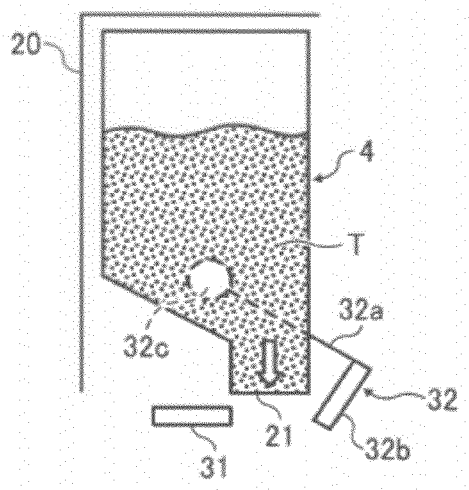
FIG. 4 is a cross-sectional view illustrating the toner container in a second position.

The toner container 4 includes a main cap member 31 and a sub-cap member 32. When the toner outlet 21 of the toner container 4 faces downward (the second position), the main cap member 31 is open to open the toner outlet 21 as FIG. 4 shows. From the second position, when the external cover 20 containing the toner container 4 is swung such that the toner outlet 21 horizontally faces to take the second position as FIG. 5 shows, the main cap member 31 closes the toner outlet 21.

Figure 6:
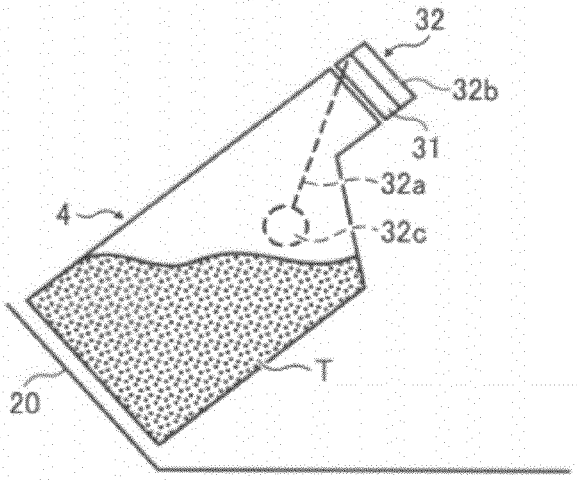
FIG. 6 is a cross-sectional view illustrating the toner container when removed.

The toner container 4 can further rotate from the first position in FIG. 5 such that the toner outlet 21 faces upward relative to a horizontal direction as FIG. 6 shows. Even in this (toner container removing) position, the main cap member 31 closes the toner outlet 21.

Figure 7A:
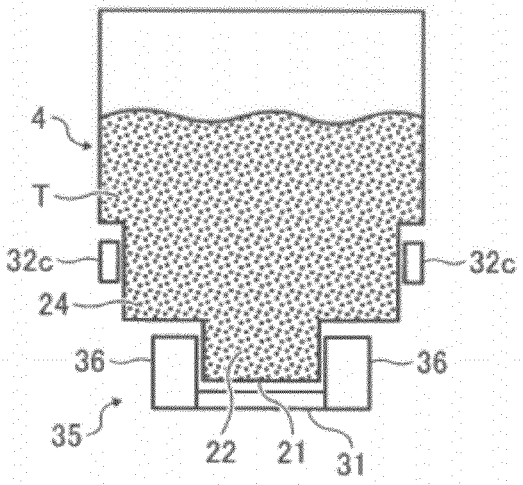
FIG. 7A is a cross-sectional rear view illustrating a relationship between the toner container and a second opening and closing member.
Figure 7B:
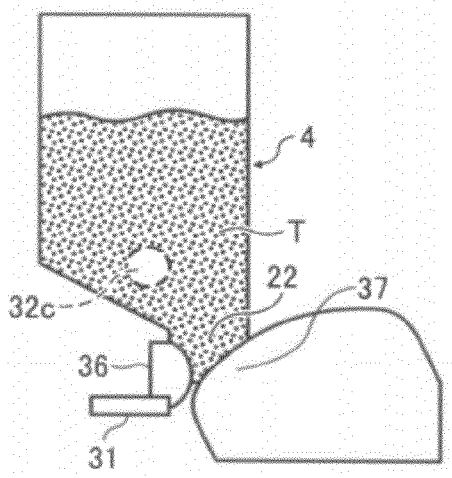
FIG. 7B is a cross-sectional side view illustrating the relationship therebetween.

The main cap member 31 operates simultaneously with swing of the toner container 4. Namely, the main cap member 31 operates simultaneously through an interlock mechanism 35 shown in FIG. 7A. The interlock mechanism 35 includes a pair of catching parts 36 connected with the main cap member 31 and an unillustrated spring member. From the first position to the second position, the pair of catching parts 36 scrape a catching part 37 of the apparatus 100, which opens the toner outlet 21 of the toner container 4 in FIG. 7B. From the second position to the first position, an elastic force of the spring member closes the toner outlet 21 of the toner container 4.

The pair of catching parts 36 are located at both sides of the projection 22 of the toner container 4, sandwiching the projection 22. Therefore, the pair of catching parts 36 and the catching part 37 do not disturb swing of the toner container 4. A width dimension of a cap of the main cap member 31 (the main cap member 31 itself) and that of a cap 32*b* of the sub-cap member 32 of the toner outlet 21 of the toner container 4 are within that of a part receiving a swing axis of the toner container 4, i.e., a narrow width part 24 mentioned later.

The sub-cap member 32 covers the surface of the main cap member 31 in the toner container removing position in FIG. 6. In this case, in the second or the first position in FIG. 4, the sub-cap member 32 does not close the main cap member 31.

Figure 8A:
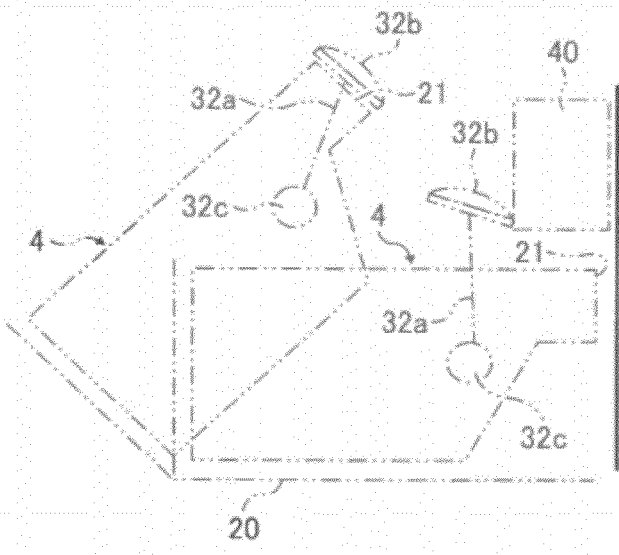
FIG. 8A is a simple side view illustrating a relationship between a brush member and a sub-cap member when the toner container is exchanged.
Figure 8B:
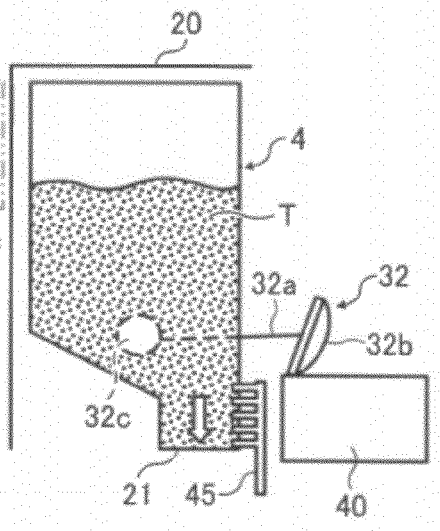
FIG. 8B is a cross-sectional view illustrating the relationship therebetween when the toner container is in the second position.

The sub-cap member 32 will be specifically explained, using FIGS. 8A and 8B. The sub-cap member 32 includes a pair of swing arms 32*a* a main support part 32*c* of the base part of the toner container 4 is connected with and the cap 32*b* attached to the tip of the swing arm 32*a*. In the toner removing position, an unillustrated elastic member presses the sub-cap member 32 such that the cap 32*b* covers the main cap member 31. Below the toner container 4, the narrow width part 24 is located in FIG. 7A, and the main support part 32*c* is located in the narrow width part 24.

Near the sub-cap member 32, a regulation member 40 the cap 32*b* is engaged with is located. Namely, in the first and second positions, from the first position to the second position, and from the second position to the first position, the cap 32*b* is engaged with the regulation member 40 and does not cover the main cap member 31 against an elastic force of the elastic member. From the first position to the toner container removing position, the cap 32*b* is released from the regulation member 40. Therefore, in the toner container removing position, the cap 32*b* covers the main cap member 31. From the toner container removing position to the first position, the cap 32*b* is engaged with the regulation member 40 and does not cover the main cap member 31.

In FIGS. 8A and 8B, a brush member 45 scrapes the main cap member 31 from the second position to the first position. Namely, the brush member 45 scrapes a toner adhering to the main cap member 31 off.

Next, an operation of exchanging the toner container 4 will be explained. First, a way of removing the toner container 4 from the apparatus 100 will be explained. The external cover 20 is opened relative to the toner container 4 to be removed as FIG. 2 shows. Thus, the toner container 4 takes the first position in which the toner outlet 21 horizontally faces as FIG. 5 shows. In the first position, the main cap member 31 closes the toner outlet 21, and the sub-cap member 32 does not cover the main cap member 31.

Then, as FIG. 6 shows, the toner container 4 is further rotated from the first position to take the toner container removing position in which the toner outlet 21 faces upward relative to the first position. In this position, the sub-cap member 32 covers the main cap member 31, in which the toner container 4 can be removed.

Next, a way of setting the toner container 4 in the apparatus 100 will be explained. First the toner container 4 is placed in the external cover 20 as shown in FIG. 6. Thus, the main cap member 31 closes the toner outlet 21, and the sub-cap member 32 covers the main cap member 31.

Then, the toner container 4 takes the first position, in which the sub-cap member 32 does not cover the main cap member 31, i.e., as shown in FIG. 5. Next, the external cover 20 is closed such that the toner container 4 takes the second position, in which the main cap member 31 is open and not covered. Thus, setting of the toner container 4 in the apparatus 100 is finished.

In the image forming apparatus 100 of the present invention, the toner outlet 21 of the toner container 4 in the second position (when feeding a toner) faces downward in a direction of gravitational force, and the toner can be fed through the toner outlet 21 into the image developer 5. Therefore, a stirrer and a feeder for feeding a toner are not needed in the toner container 4. Namely, the image forming apparatus 100 of the present invention has a simple and low-cost configuration capable of feeding a toner into the image developer 5 from the toner outlet 21 without the stirrer and the feeder for feeding a toner.

When removing the toner container 4, the main cap member 31 closes the toner outlet 21, scattering of a toner therefrom can be prevented. Even when the main cap member 31 closes the toner outlet 21 in the first position and the toner container removing position, the toner T occasionally adheres to the surface of the main cap member 31. Therefore, in the present invention, the toner outlet 21 faces upward relative to the first position when removing the toner container 4, and the sub-cap member 32 covers the main cap member 31 from the first position to the toner container removing position. Thus, even when some toners T adheres to the main cap member 31, scattering of a toner T therefrom can be reduced. Namely, scattering of a toner T when removing the toner container 4 can effectively be prevented, contamination thereby can be avoided, and a user does not have to exchange the toner container 4 with careful attention to scattering of a toner T, which simplifies the operation of exchanging the toner container 4. Locating the toner outlet 21 of the toner container 4 above in the toner container 4 in the first position can stably prevent the toner T from flowing out from the toner outlet 21. The toner outlet 21 has a large trajectory when the toner container 4 swings, and torque for opening and closing the main cap member 31 is advantageously obtainable with ease. The width dimension of the toner outlet 21 of the toner container 4 can advantageously be fixed to offer a small-size toner container 4.

The toner container 4 has good operability because the toner outlet 21 can be closed only by changing the position of the toner container 4 from the second position to the first position.

The external cover 20 is opened to change the position of the toner container 4 from the second position to the first position, which can ease the operation of exchanging the toner container 4 without skill and shorten the time thereof. Each of the toner containers 4 is equipped with an external cover 20 which opens when exchanging the toner container 4. In the toner container 4 which does not need exchange, the abrasion of the main cap member 31 (a seal member) due to opening and closing operations thereof can be avoided and scattering of a toner can stably be prevented for long periods.

Figure 9:
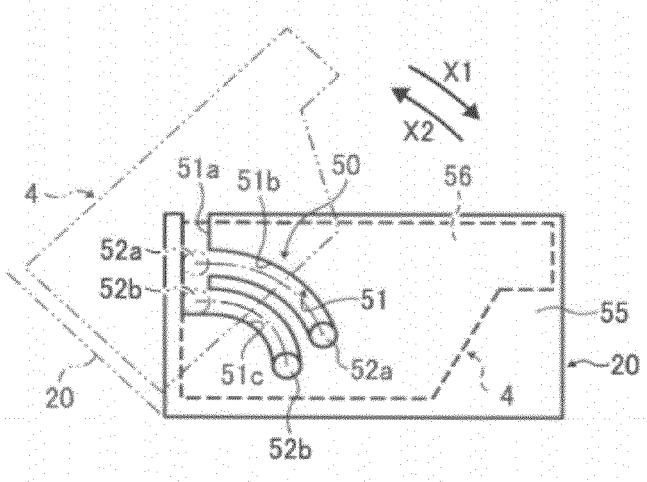
FIG. 9 is a schematic view illustrating a relationship between the toner container and a guide mechanism.

In FIG. 9, a guide mechanism 50 guides the toner container 4 from the toner container removing position to the first position. The guide mechanism 50 includes a groove 51 on a pair of side walls 55 the external cover 20 faces, and projections 52*a* and 52*b* on a pair of side walls 56 the toner container 4 faces. Each groove 51 includes a straight groove portion 51*a* opening onto an upper side of the side wall 55 and circular groove portions 51*b* and 51*c* continuous with the straight groove portion 51*a*.

The toner container 4 is covered by the external cover 20 such that the projections 52*a* and 52*b* of the toner container 4 are jointed into the straight groove portion 51*a* (shown in a virtual line in FIG. 9). The (upper) projection 52*a* to the (upper) circular groove portion 51*b* and the (lower) projection 52*b* to the (lower) circular groove portion 51*c*. When the toner container 4 is swung in an arrow X1 direction, the upper projection 52*a* is jointed into the upper circular groove portion 51*b* and the lower projection 52*b* into the lower circular groove portion 51*c*.

Thus, with the swing of the toner container 4 in an arrow X1 direction, the projections 52*a* and 52*b* enter deep in the circular groove portions 51*b* and 51*c*, respectively, and the toner container 4 takes the first position. In the first position, the projections 52*a* and 52*b* are located deep in the circular groove portions 51*b* and 51*c*, respectively.

When the toner container 4 is swung in an arrow X2 direction from the first position, the projections 52*a* and 52*b* scrape in the circular groove portions 51*b* and 51*c* in the arrow X2 direction, respectively, i.e., the projections 52*a* and 52*b* enter the straight groove portion 51*a*. Then, the toner container 4 is elevated such that the projections 52*a* and 52*b* are drawn from the straight groove portion 51*a* to take out the toner container 4 from the external cover 20.

The guide mechanism 50 can easily and stably exchange the toner container 4.

Figure 10:
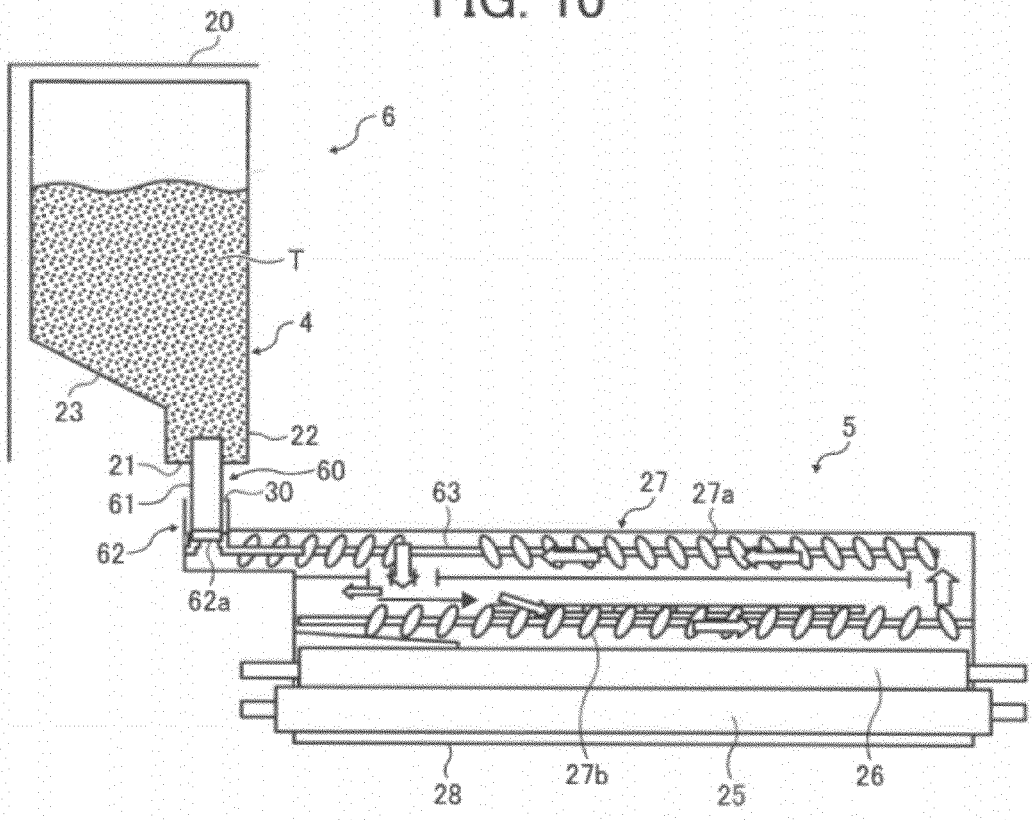
FIG. 10 is a cross-sectional view illustrating a relationship between the toner container and an image developer (developing unit), including an unstiffening member.

In FIG. 10, an unstiffening member 60 unstiffens a toner near the toner outlet 21 in the toner container 4, entering the toner outlet 21 of the toner container 4 from the toner feed opening 30 of the image developer 5. The unstiffening member 60 is driven with the rotation of the toner feed member 27 of the image developer 5 and formed of a reed-shaped film oscillation body 61 reciprocating in the toner outlet 21.

Namely, a wire stirring member 62 is located at the toner feed opening 30 side of an axis 63 of the first feed screw 27*a* forming the toner feed member 27, and the oscillation body 61 is attached to stirring member 62. The stirring member 62 includes a rotating part 62*a* eccentrically located from the axis 63 of the first feed screw 27*a*, and the base of the oscillation body 61 is connected with the rotating part 62*a*.

When the first feed screw 27*a* which is a feed member of the image developer 5 is driven, the axis 63 of the first feed screw 27*a* axially rotates. With the rotation, the rotating part 62*a* eccentrically rotates to reciprocate the oscillation body 61, which can unstiffen a toner near the toner outlet 21 in the toner container 4. In addition, the eccentric rotation of the rotating part 62*a* can unstiffen a toner near the toner feed opening 30.

Thus, the unstiffening member 60 can unstiffen a toner near the toner outlet 21 in the toner container 4, which stably feeds a toner from the toner outlet 21 and prevents the outlet 21 from being clogged with a toner.

The image forming apparatus 100 of the present invention includes electrophotographic copiers, laser beam printers, facsimiles, and the like. An angle (relative to a level surface) of the toner container removing position can optionally be selected as long as a user can remove or fix the toner container 4. A pair of the guide mechanisms 50 are formed on the side walls 55, but may be on one side wall 55 thereon.

This application claims priority and contains subject matter related to Japanese Patent Application No. 2010-174512, filed on Aug. 3, 2010, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus, comprising:

an image developer configured to develop an electrostatic latent image;

a toner container comprising:

a toner outlet through which toner is delivered;

a main cap member configured to close the toner outlet; and a sub-cap member configured to cover the main cap member; and a toner provider configured to deliver toner from the toner container to the image developer using gravity, wherein the toner container is displaceable between a first position of positioning the toner outlet in a horizontal direction, a second position of positioning the toner outlet in a vertical direction, and a third position of being removed, thereby directing the toner outlet upward relative to the horizontal direction when further rotating the toner container from the first position, with the main cap member closing the toner outlet when taking the first position and the third position of being removed and the sub-cap member covering the main cap member while the toner container is displaced from the first position to the third position of being removed.

2. The image forming apparatus of claim 1, wherein the toner outlet is located at a top portion of the toner container in the first position.

3. The image forming apparatus of claim 2, wherein:

the main cap member comprises a cap;

the sub-cap member comprises a cap; and the toner outlet, the main cap member cap, and the sub-cap member cap are dimensioned to fit within a part of the toner container constituting a swing axis of the toner container.

4. The image forming apparatus of claim 1, wherein the main cap member comprises a catching part configured to contact the image forming apparatus and swing to close the toner outlet when the toner container is displaced from the second position to the first position, the catching part located so as not to restrict swinging of the toner container.

5. The image forming apparatus of claim 1, wherein the toner container further comprises an external cover, and the toner container is displaced from the second position to the first position in conjunction with opening of the external cover.

6. The image forming apparatus of claim 1, further comprising a brush member configured to scrape the main cap member when the toner container is displaced from the second position to the first position.

7. The image forming apparatus of claim 1, further comprising multiple toner containers each comprising an external cover which is open when the toner container is replaced.

8. The image forming apparatus of claim 1, further comprising a guide mechanism configured to guide displacement of the toner container from the third position of being removed to the first position.

9. The image forming apparatus of claim 1, further comprising a stirrer positioned within the toner outlet of the toner container from a toner feed opening of the image developer to loosen toner accumulated near the toner outlet in the toner container.

10. The image forming apparatus of claim 9, wherein the stirrer comprises an oscillating body that moves reciprocally within the toner outlet and is driven in conjunction with the rotation of a toner feed member of the image developer.

* * * * *